US008446083B2

(12) United States Patent
Ikeda

(10) Patent No.: US 8,446,083 B2
(45) Date of Patent: May 21, 2013

(54) LIGHT EMITTING APPARATUS

(75) Inventor: Kouji Ikeda, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 13/071,393

(22) Filed: Mar. 24, 2011

(65) Prior Publication Data

US 2011/0234083 A1 Sep. 29, 2011

(30) Foreign Application Priority Data

Mar. 26, 2010 (JP) ..... 2010-071937

(51) Int. Cl.
*H01J 5/50* (2006.01)

(52) U.S. Cl.
USPC ..... 313/331

(58) Field of Classification Search
USPC ..... 313/331, 498–512; 345/45
See application file for complete search history.

(56) References Cited

U.S. PATENT DOCUMENTS

| | | | | |
|---|---|---|---|---|
| 2005/0184927 | A1* | 8/2005 | Kwak | 345/45 |
| 2006/0284803 | A1 | 12/2006 | Ikeda | |
| 2007/0013299 | A1* | 1/2007 | Hamada et al. | 313/505 |
| 2008/0130210 | A1* | 6/2008 | Komori | 361/681 |
| 2009/0115708 | A1* | 5/2009 | Sagawa et al. | 345/76 |

* cited by examiner

*Primary Examiner* — Anh Mai
*Assistant Examiner* — Zachary J Snyder
(74) *Attorney, Agent, or Firm* — Canon USA Inc IP Division

(57) ABSTRACT

In a light emitting apparatus including a plane-shape light emitting area, a power supply area extending along the light emitting area, and a power supply voltage feeding part configured to feed a power supply voltage to the power supply area. The power supply area supplies a current to the light emitting area across an edge of the power supply area facing the light emitting area. The power supply voltage feeding part is connected to a power supply port provided on another edge of the power supply area opposite to the light emitting area. The power supply area includes a first non-conductive area surrounded by a conductive area located on a shortest path from the power supply port to the edge of the power supply area facing the light emitting area.

5 Claims, 11 Drawing Sheets

LIGHT EMITTING APPARATUS

BACKGROUND OF THE INVENTION

1. Field of the Invention

The present invention relates to a light emitting apparatus, and more particularly, to a light emitting apparatus functioning as a display apparatus or a lighting apparatus using a light emitting element such as an organic electroluminescent element.

2. Description of the Related Art

The organic electroluminescent element is a light emitting element configured such that an organic material including a light emitting layer is disposed between two electrodes serving as a cathode and an anode respectively thereby emitting light with luminance depending on a current flowing between the electrodes. In an organic electroluminescent element for use in a lighting apparatus, each of two electrodes is formed in the shape of a solid plate, and one of them is transparent so that light can be radiated outward through the transparent electrode. Electric power to drive the organic electroluminescent element is supplied from a voltage supply generator through a power supply port and applied between the two electrodes directly or through a driving circuit.

In the case of a display apparatus of the active matrix type, organic electroluminescent elements are arranged in the form of a matrix, and the organic electroluminescent elements are independently controlled to emit light such that an image is displayed as a whole. A power supply voltage is supplied to driving circuits of respective organic electroluminescent elements via pixel power supply lines formed in the shape of a lattice or stripes extending along rows or columns of the matrix of organic electroluminescent elements. Each driving circuit is connected to a cathode or an anode of a corresponding one of the organic electroluminescent elements such that each organic electroluminescent element is driven by a supplied power supply voltage. An electrode opposite to the electrode connected to one of the driving circuits is formed in the shape of a single solid plate for common use by all organic electroluminescent elements. This common electrode is supplied with another power supply voltage, which is a ground voltage in most cases.

In display apparatuses using light emitting elements such as an organic electroluminescent element driven by an electric current, a large current flows through a power supply area extending from a power supply port to the light emitting element compared with a current in a display apparatus using a voltage-driven element such as a liquid crystal element. This current produces a voltage drop along the power supply area and thus the potential decreases with distance from the power supply port. Therefore, the power supply voltage applied to the driving circuits of the organic electroluminescent elements arranged in the form of the matrix varies depending on their location in a display area, which can produce a variation in light emission luminance among the organic electroluminescent elements. The common electrode (and also the electrode of the lighting apparatus) is formed in the shape of a single solid plate. In a case where the common electrode is located on a side through which light is radiated to the outside, the electrode is formed of a transparent electrically conductive material such as ITO. However, such an electrode using a transparent electrically-conductive material has a high sheet resistance compared with a metal electrode. Even in the plane-shape electrode, if it has a high sheet resistance, a voltage drop across the electrode can occur due to a current flowing through the electrode, which can produce a variation in luminance across the electrode.

To reduce the voltage drop along the power supply area, the power supply area may be formed using a thicker and/or wider conductive film to reduce its sheet resistance. However, the increase in the width of the power supply area results in an increase in the size of the display apparatus, which may make it difficult for the display apparatus to be used in a small-size electronic device. Another possible method to reduce the voltage drop is to provide a large number of connection terminals via which electric power is supplied to the power supply area. For example, a total of four connection terminals may be provided such that one connection terminal is located in each of four corners of the display apparatus. However, the increase in the number of connection terminals via which to provide power supply voltages from the outside of the display apparatus may result in a reduction in space to dispose other connection terminals such as those for control signal lines, data signal lines, etc. Furthermore, the provision of connection terminals at many locations may cause an increase in members or materials such as a conductive film associated with the connection terminals, which may result in an increase in cost.

U.S. Patent Application Publication No. 2006/0284803 discloses a display apparatus in which a current supply line with a large width is provided at a side of a display area in which organic electroluminescent elements are arranged in the form of a matrix such that a current is supplied into the display area across the side of the display area. The current supply line is partially cut in a direction parallel to the side of the display area such that one end of the current supply line is partially divided by slits. The partially divided end of the current supply line is connected to a power supply. A current fed from the power supply into the current supply line flows through a detour path around the slits, which leads to an improvement in uniformity of potential in an area close to a boundary to the display area compared with a power supply line having no slits.

In the above-described display apparatus disclosed in U.S. Patent Application Publication No. 2006/0284803, although the terminal for connection with the power supply is located at the end of the power supply line, it is possible to achieve a voltage drop similar to that which occurs in a power supply line having a connection terminal located in the center of a side of the power supply line. However, this configuration still has an uneliminated voltage drop along the side from its center to its end.

SUMMARY OF THE INVENTION

According to an aspect, the present invention provides a light emitting apparatus including: a plane-shape light emitting area; a power supply area extending along the light emitting area, the power supply area supplying a current to the light emitting area across an edge of the power supply area facing the light emitting area; and a power supply voltage feeding part configured to feed a power supply voltage to the power supply area, the power supply voltage feeding part being connected to the power supply area at a power supply port provided on another edge of the power supply area opposite to the edge facing the light emitting area, wherein the power supply area includes a first non-conductive area surrounded by a conductive area located on a shortest path from the power supply port to the edge of the power supply area facing the light emitting area. According to one aspect, the above-described configuration of the power supply area causes a current to flow in the power supply area along a detour path, which results in an increase in length of a shortest path. This leads to a reduction in difference in potential between a point at which a greatest voltage drop occurs in the power supply area and a point at which a smallest voltage drop occurs. That is, it becomes possible to suppress the difference in potential between the point at which the voltage drop from the voltage at the terminal wiring conductor is the greatest and the point at which the voltage drop is the smallest. Furthermore, because current streams flowing along two detour paths combined into a single stream at the back of the non-conductive area, it is possible to obtain a flat potential distribution in the area at the back of the non-conductive area.

Further features of the present invention will become apparent from the following description of exemplary embodiments with reference to the attached drawings.

DESCRIPTION OF THE EMBODIMENTS

A light emitting apparatus according to one of embodiments described below may be used as a display apparatus or a lighting apparatus.

Figure 1:
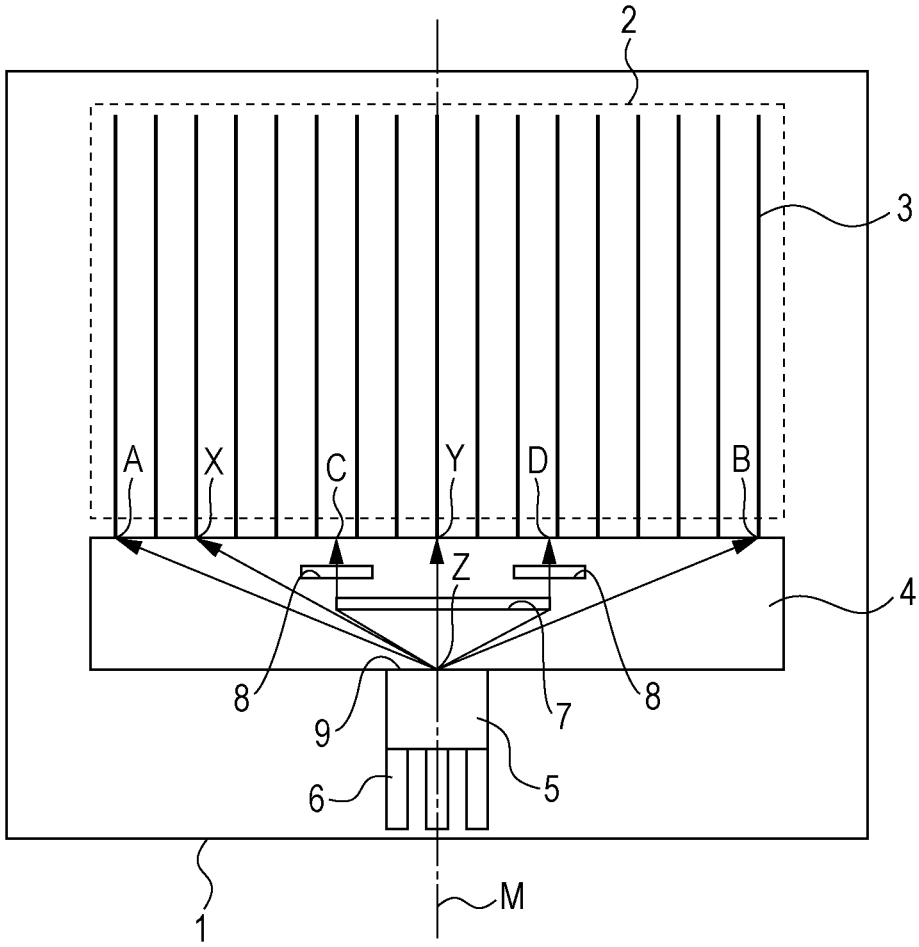
FIG. 1 is a diagram illustrating power supply paths in a display apparatus according to an embodiment of the present invention.

FIG. 1 is a diagram illustrating power supply paths of a light emitting apparatus according to an embodiment of the present invention.

Organic electroluminescent elements (not shown) are arranged in the form of a two-dimensional matrix in a plane-shape display area 2 defined on an organic electroluminescent display substrate 1. In the display area 2, a plurality of pixel power supply lines 3 are formed in the shape of thin stripes to supply a power supply voltage to each organic electroluminescent element. Furthermore, in the outside of the display area 2, a power supply area 4 is formed along a side of the display area 2. In a case where the display area 2 is rectangular in shape, the power supply area 4 may be formed along two opposite sides or along three sides of the display area 2.

An edge, along the side of the display area 2, of the power supply area 4 is connected to pixel power supply lines 3, while the other edge opposite to the display area 2 is connected to a terminal wiring conductor 5. The terminal wiring conductor 5 is connected to a connection terminal 6 to receive a power supply voltage from the outside of the substrate 1. The terminal wiring conductor 5 may be removed and the power supply area 4 may be directly connected to the connection terminal 6. The power supply voltage is fed to the power supply area 4 via the terminal wiring conductor 5 and the connection terminal 6, and thus the combination of the terminal wiring conductor 5 and the connection terminal 6 is called a power supply voltage feeding part. The edge of the power supply area 4 at which the power supply area 4 is connected to the power supply voltage feeding part is called a power supply port 9. Note that the power supply port 9 also serves as a port via which a current is supplied to the power supply area 4.

In the following description, it is assumed that the current is fed into the power supply area 4 via the power supply port 9 and fed out from the power supply area 4 via the edge thereof extending along the side of the display area 2. Note that the current may flow in an opposite direction. In the case where the current flows in the opposite direction, it may be regarded that a negative current is fed into the power supply area 4 via the power supply port 9, and the following description may be read reversely in terms of the potential on the power supply area.

Because the power supply area 4 is located outside the display area 2, it is allowed to form the power supply area 4 to have a wider width than the width of the pixel power supply lines 3 located in the display area 2 such that the power supply area 4 has a low resistance per length along the side of the display area. This allows a reduction in voltage drop in the power supply area 4, which allows the pixel power supply lines 3 extending from the power supply area 4 into the display area 2 to have nearly equal potentials at points where the pixel power supply lines 3 are connected to the power supply area 4.

An electrode on the opposite side of the organic electroluminescent element serves as a cathode. The cathode electrode entirely covers the display area and is used in common by all organic electroluminescent elements. A power supply area for use by the common electrode may be provided in a similar form to the power supply area 4 described above. More specifically, another power supply area may be formed in an area at a side of the display area 2 other than the side at which the power supply area 4 for the anode is formed such that this additional power supply area extends along the side of the display area 2, and the common electrode is extended beyond this side such that the common electrode is connected to the additional power supply area. A current flowing through the common electrode is fed out into the power supply area across this side. By forming the power supply area to have a lower sheet resistance than that of the common electrode, it becomes possible for the current flowing through the common electrode to flow in a substantially parallel form in a direction toward the power supply area, and thus it becomes possible to suppress the voltage drop in the common electrode.

In the case where the light emitting apparatus is used as a lighting apparatus, an organic electroluminescent element is formed over an entire light emitting area corresponding to the display area of the display apparatus. Electrodes of the lighting apparatus are each formed in the shape of a single sheet covering the entire light emitting area, and a power supply area may be provided for each electrode in a similar manner to that for the common electrode of the display apparatus. In particular, by forming the power supply area for a transparent electrode on a side through which light is emitted to the outside such that this power supply area has a lower sheet resistance than that of the transparent electrode, it is possible to effectively achieve a uniform voltage on the transparent electrode over the entire light emission area.

In both cases of the display apparatus and the lighting apparatus, by forming the power supply area with a low resistance outside the light emitting area along one or more sides of the light emitting area, it is possible to minimize the voltage distribution in the light emitting area. However, as described earlier, the power supply area itself has a non-zero resistance although it is not high, and the resistance can cause a voltage drop to occur in the power supply area depending on a current flowing through the power supply area, which may influence the voltage distribution in the light emitting area.

Referring again to FIG. 1, in a case where the power supply port 9 is located on a center line M of the display area 2, a point Z at the cent of the power supply port 9 is selected as a representative position of the power supply port 9, and a point opposite to Z is denoted by Y. Furthermore, points that are located on the edge of the power supply area 4 and that are farthest from the point Y are denoted by points A and B. A voltage drop ΔV at a point X, serving as an exit via which a current is fed out from the power supply area 4, is given as follows:

$$\Delta V = i_{av}\rho_s L \quad (1)$$

where $i_{av}$ is an average current density along a current path from Z to X, $\rho_s$ is a sheet resistance, and L is the length of the current path.

At the power supply port 9, the current flowing into the power supply area 4 has a substantially uniform density. At the edge AB extending along the display area 2, the amount of current flowing out into the display area 2 is substantially equal at any point on the entire edge AB, and thus the current density is also uniform. The manner in which the current density changes along the current path does not depend on the current path, and thus it can be regarded as $i_{av}$ does not greatly depend on the length of the current path. Therefore, the voltage drop ΔV is substantially proportional to the length L of the current path or, at least, the voltage drop ΔV increases as the length L increases.

In a case where the power supply area has a rectangular shape or other simple shapes similar to a rectangle, the path of the current in the power supply area 4 can be regarded as being linear except for a part close to the edge. Therefore, roughly speaking, the voltage drop is determined by the length of the line distance in the power supply area 4 from the power supply port 9 (the great the length, the greater the voltage drop).

In embodiments of the present invention, a non-conductive area is provided in a conductive area of the power supply area 4. The current in the power supply area 4 flows through the conductive area but no current flows through the non-conductive area. The provision of the non-conductive area makes it possible to minimize the difference in potential among the current exits.

More specifically, a slit 7 serving as the non-conductive area is formed in the power supply area 4 such that the slit 7 extends across a line path ZY that is a geometrically shortest path from the power supply port 9 to the edge along the light emitting area. The slit 7 is located within the power supply area 4 and is entirely surrounded by the conductive area without communicating with the outside. In this configuration having the slit 7 formed in the above-described manner, the current fed from the power supply port 9 is split into two streams by the slit 7 and the two split streams combine together at the back of the slit 7 after flowing along detour paths around the slit 7.

Because the voltage drop in the power supply area 4 is determined by the length of the line path, the provision of the slit 7 causes the shortest path to shift to ZC and ZD from ZY and thus the length of the shortest paths becomes closer to the length of longest paths ZA and ZB. This leads to a reduction in distribution width of potential along AB.

The current fed in from Z flows toward respective points on the edge AB. In a configuration in which there is no slot, a smallest voltage drop with respect to the point Z occurs at the point Y, while greatest voltage drops occur at points A and B. In contrast, in the present configuration in which the slit 7 exists, the smallest voltage drop with respect to the point Z occurs at two points C and D that are the closest points on the edge AB from either end of the slit 7. At the points C and D, the potential has a highest value among all points on the edge AB of the power supply area 4.

The current flows along detour paths around ends of the slit 7, and, in the area at the back of the slit 7, the stream passing by the left end of the slit 7 and the stream passing by the right end of the slit 7 combine into a single stream. As can be seen from equation (1), the resistance of a current path corresponds to the length L of the current path. In a case where there are two current paths, the voltage drop is determined by the harmonic mean of the lengths of the two paths. The length is equal for two paths that start from Z and end at Y after passing by either one of the two ends of the slit 7. For any end point located between Y and C, the path passing around the end closer to C is shorter than the path passing around the end closer to D. For any end point located between Y and D, the opposite path has a greater length. In either case, two current streams passing along different detour paths cancel out the difference in voltage drop. As a result, an improvement is achieved in uniformity of potential in the area at the back of the slit 7.

In the configuration having the slit 7, the shortest path from the point Z to the edge AB is given by paths ZC and ZD. In each of these paths ZC and ZD, a slit 8 serving as another non-conductive area may be formed in the middle of a linear path from either end of the slit 7 to the edge AB. Each slit 8 is completely surrounded by the conductive area without communicating with the outside. Each slit forms an independent non-conductive area, that is, there is no connection between the slit 7 and either one of the slits 8 and there is no connection between the two slits 8.

The current fed in from the power supply port 9 is split into two streams by the slit 7, and each stream is further split into two streams by each slit 8. In this configuration, shortest paths are those which pass around the slit 7 and further one of the slits 8, and thus this configuration leads to a further reduction in the difference between the length of the longest path and the length of the shortest path. Furthermore, because the current flows along detour paths around both ends of each slit, a further improvement is achieved in terms of uniformity in potential in an area between the two ends of the slit.

The number of stages of slits may be increased to achieve a further improvement in uniformity of potential. More specifically, for example, two second non-conductive areas (slits 8) may be provided close to respective ends of a first non-conductive area (slit 7) that is a non-conductive area closest to the power supply port 9, and four third non-conductive areas may be provided in shortest paths from respective four ends of the second non-conductive areas to the edge AB. By properly selecting the number of stages of slits, it is possible to reduce the potential distribution width among current exits to a predetermined level.

When the power supply port 9 is located on the center line M of the display area 2, the slit 7 may be formed to have a shape symmetric with respect to the power supply port 9. In this configuration, the potential distribution along the edge AB is symmetric with respect to the center line M, and this configuration leads to a least difference between a highest potential and a lowest potential.

Figure 2:
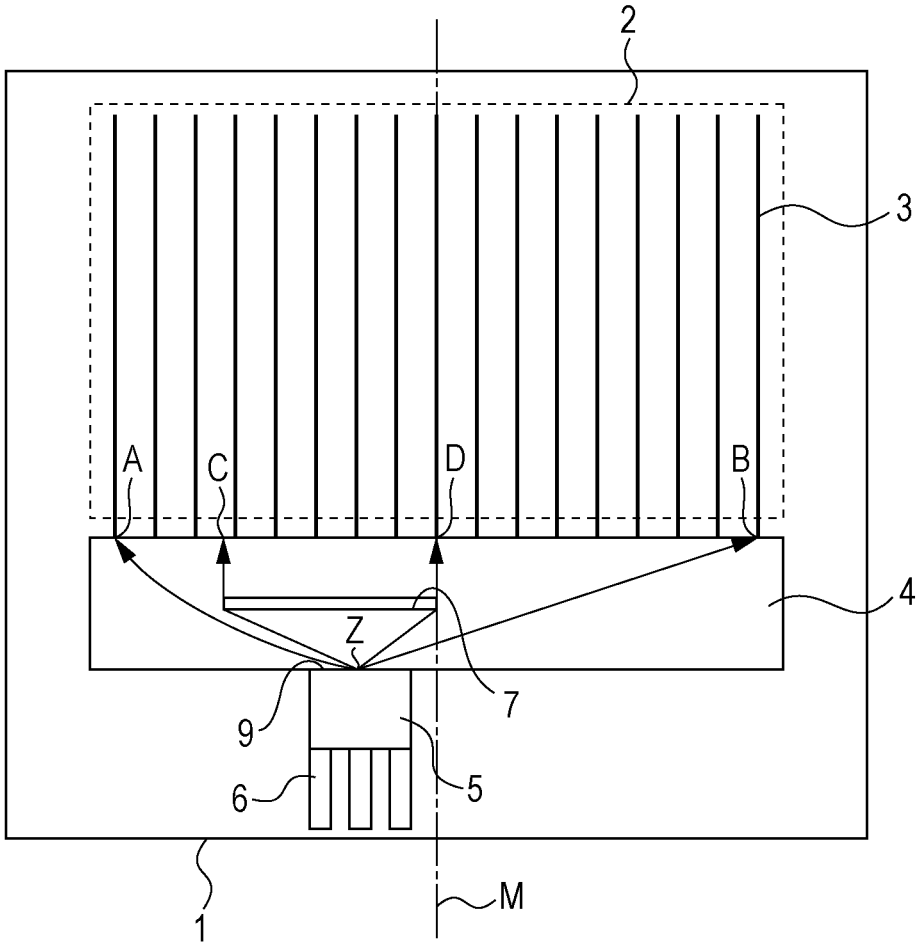
FIG. 2 is a diagram illustrating power supply paths in a display apparatus according to an embodiment of the present invention.

FIG. 2 illustrates a manner in which the slit 7 is formed for a case where the center of the power supply port 9 is at a location shifted in either direction from the center line M of the display area 2. In the case where the center of the power supply port 9 is shifted from the center line M of the display area 2, the center of the slit 7 may be shifted in the same direction as the direction in which the power supply port 9 is shifted such that the slit 7 is asymmetric with respect to the center of the power supply port as shown in FIG. 2. In a case where the center of the power supply port 9 is shifted from the center line M in a direction toward A, the slit 7 may be formed such that the center thereof is shifted in the direction toward A by a greater amount than the amount by which the power supply port 9 is shifted. In this configuration, among two line paths ZC and ZD passing by either end of the slit 7, the line path ZC is longer than the line path ZD, and thus the potential at C is lower than the potential at D. On the other hand, a current path from Z to A is not linear but this current path greatly detours. Thus, a greater voltage drop occurs than would occur if the path were linear, which causes the voltage drop to become close to the voltage drop along the path ZB. As a result, a reduction is achieved in the difference between the highest potential and the lowest potential along the edge AB compared with the difference obtained for the configuration in which the slit 7 is formed to be symmetric with respect to the center of the power supply port 9.

Shapes of non-conductive areas are not limited to rectangular slits, but non-conductive areas may be formed in various shapes such as a circle, a triangle whose one vertex is located at the side of the power supply port and bottom side is parallel to the edge AB. In any shape, each non-conductive area is located on a shortest linear path from the power supply port to one of current exits, and each non-conductive area is completely surrounded by the conductive area. That is, each non-conductive area is located such that the non-conductive area extends across a path that would be a shortest current path in the configuration including no non-conductive area, and thus the current is split into two streams by the non-conductive area and the path has a greater length than the length obtained in the configuration including no non-conductive area. This results in a reduction in the highest potential among potentials at current exits, and thus a less potential distribution width is obtained. Furthermore, in any configuration, because each non-conductive area is surrounded by the conductive area, the split streams combine together after passing along a detour path around ends of the non-conductive area, and the combined stream reaches current exits. At each current exit, voltage drops due to two current streams are averaged, and thus a flat potential distribution is obtained in an area at the back of the non-conductive area. As a result, an improvement is achieved in terms of the uniformity of potential along the edge along the display area.

The light emitting apparatus according to the present invention is described in further detail below with reference to specific embodiments. In the following embodiments, it is assumed by way of example that the light emitting apparatus is applied to an active matrix display apparatus using organic electroluminescent elements. Note that the present invention may be applied to other types of display apparatuses.

Figure 3:
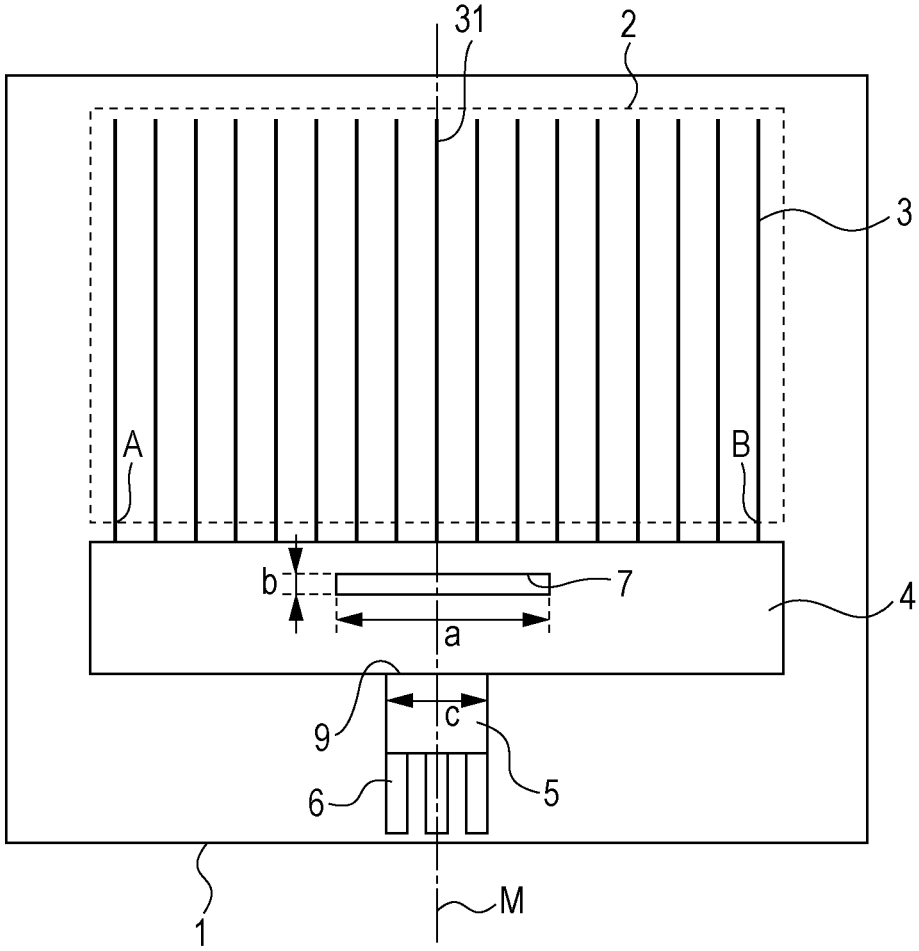
FIG. 3 is a diagram illustrating a layout of power supply paths in a display apparatus according to an embodiment of the present invention.

FIG. 3 illustrates a manner in which a power supply area is formed in an organic electroluminescent display apparatus according to a first embodiment of the present invention. In FIG. 3, similar parts to those in FIG. 1 are denoted by similar reference numerals or symbols.

Organic electroluminescent elements (not shown) of three colors, i.e., red, green, and blue and pixel circuits (not shown) that supply currents to respective organic electroluminescent elements are arranged in the form of a two-dimensional matrix in a display area 2 defined on a substrate 1. Pixel power supply lines 3 are formed to supply currents to anodes of respective organic electroluminescent elements via corresponding pixel circuits.

A power supply area 4 is formed by patterning a metal film such that the power supply area 4 has a slit 7 with a length a and a width b at the center of the power supply area 4. Note that the slit 7 is an area where there is no metal film. The slit 7 is located between a terminal wiring conductor 5 and a pixel power supply line 31 that is a pixel power supply line located closest to the terminal wiring conductor 5 such that the slit 7 extends in a direction parallel to a lower side of the display area 2. That is, the slit 7 is located in the middle of a path that would be, if there were no slit 7, a shortest path along which a current would flow in the power supply area 4 toward the pixel power supply lines 3. The presence of the slit 7 causes the current to flow along a detour path around the slit 7, and the shortest current path becomes longer than that obtained in the configuration having no slit 7.

A power supply port 9 of the power supply area 4 is formed on a center line M such that the terminal wiring conductor 5 is in contact with the power supply area 4 along a predetermined width c at the power supply port 9. A current fed into the power supply area 4 from the terminal wiring conductor 5 flows toward exits while spreading out equally to right and left. In a case where the terminal wiring conductor 5 is located at the center of an edge of the power supply area 4, the path length can be calculated by regarding that each path starts from the center point of the width C, and the shortest path and the longest path can be determined based on the calculation.

Figure 4:
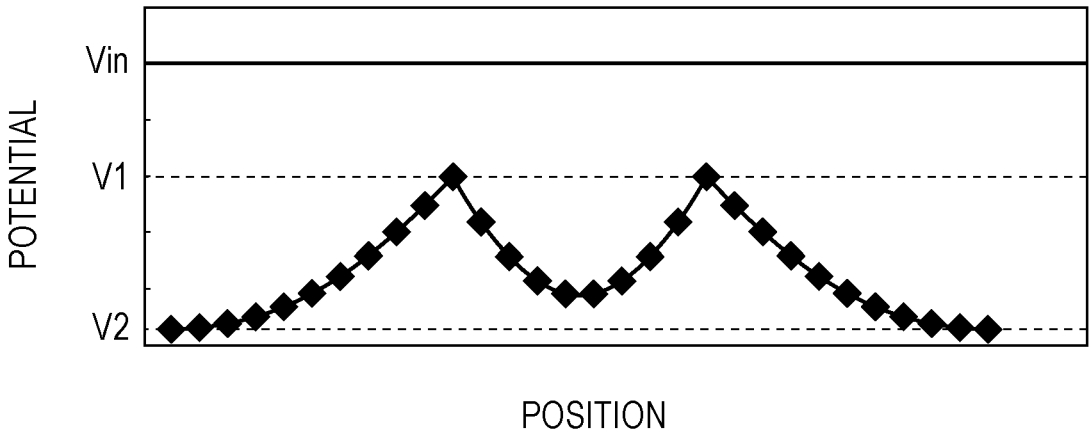
FIG. 4 is a diagram illustrating a potential distribution in a power supply area shown in FIG. 3.

FIG. 4 illustrates a potential distribution along an edge AB of the power supply area 4 facing the display area 2 shown in FIG. 3. A horizontal axis indicates a position along the edge AB of the power supply area 4, and a vertical axis indicates a potential. Arrows a and c indicate locations of the slit 7 and the power supply port 9, respectively. The terminal wiring conductor 5 and the slit 7 are located in the center between points A and B. Vin is the potential at the power supply port 9.

Among all paths from the power supply port 9 to one of points on the edge AB after passing a detour path around the slit 7, shortest paths are those (ZC and ZD) that pass by either a right end or a left end of the slit 7, and a smallest voltage drop occurs along these paths. Therefore, among potentials along the edge AB of the power supply area 4, a highest potential V1 occurs at points C and D corresponding to respective ends of the slit 7. The existence of two points at which the potential has the highest value flattens the potential distribution between these two points. In particular, a flat potential distribution is achieved in a range close to a point Y located at the center between the points C and D. On the other hand, at the points A and B that are the farthest from the power supply port 9, potentials are greatly reduced down to V2 by a voltage drop produced by a current flowing through the power supply area.

The potential along the edge AB was calculated by simulation. In the simulation, it was assumed that the width of the power supply area 4 was a unit length 1, the length (AB) of the power supply area 4 along the side of the display area 2 was 30 times greater than the unit length, the length a of the slit 7 was 8 times greater than the unit length, and the width c of the terminal wiring conductor 5 is 6 times greater than the unit length. Furthermore, the width b of the slit 7 was assumed to be very small, and the width b was set to be equal to 0 in the simulation. The power supply port 9 was assumed to be located on the center line M of the power supply area 4, and the slit 7 was assumed to be symmetric with respect to the center line M. It was also assumed that the slit 7 was located at a point at which the width of the power supply area 4 is internally divided into a ratio of 3 (part close to the terminal wiring conductor):1 (part close to the display area). The current per unit length flowing into the display area 2 was assumed to be equal to I, and the power supply area 4 was assumed to have a sheet resistance of 1. The result of the simulation was as follows:

$$V1=V\text{in}-43I$$

and $$V2=V\text{in}-96I.$$

Thus, the difference between the highest potential V1 and the lowest potential V2 was equal to 53I.

Figure 9:
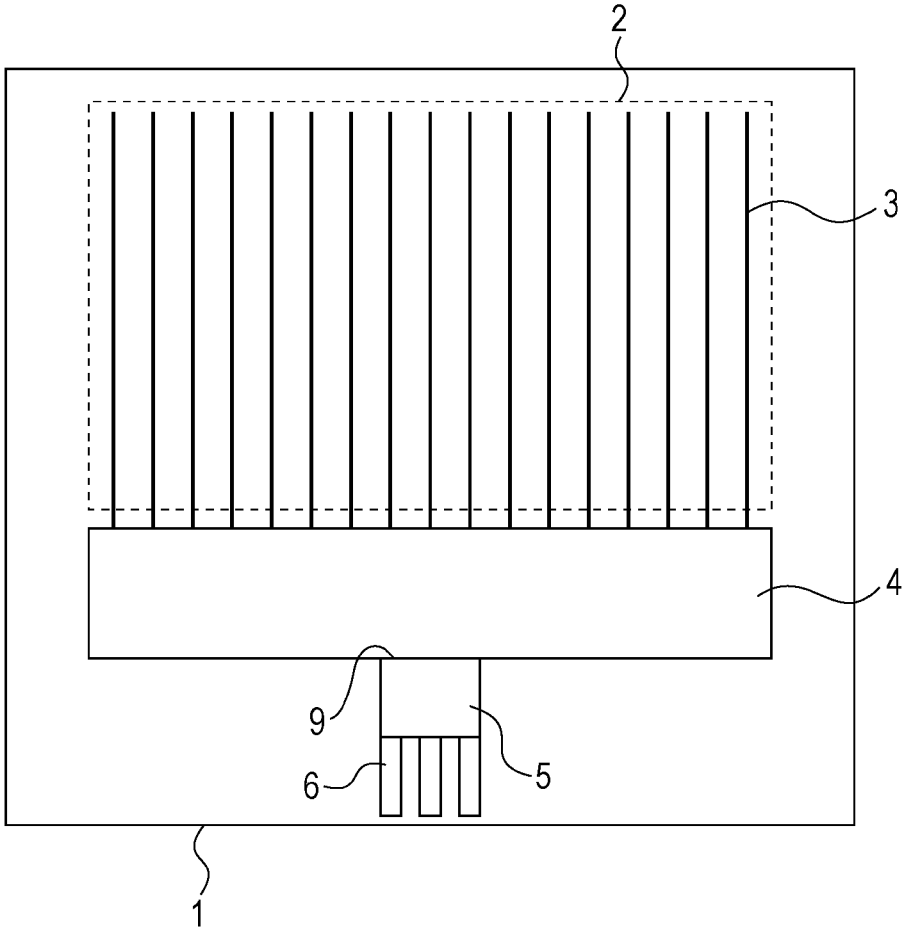
FIG. 9 is a diagram illustrating a layout of power supply paths in a display apparatus of a comparative example.
Figure 10:
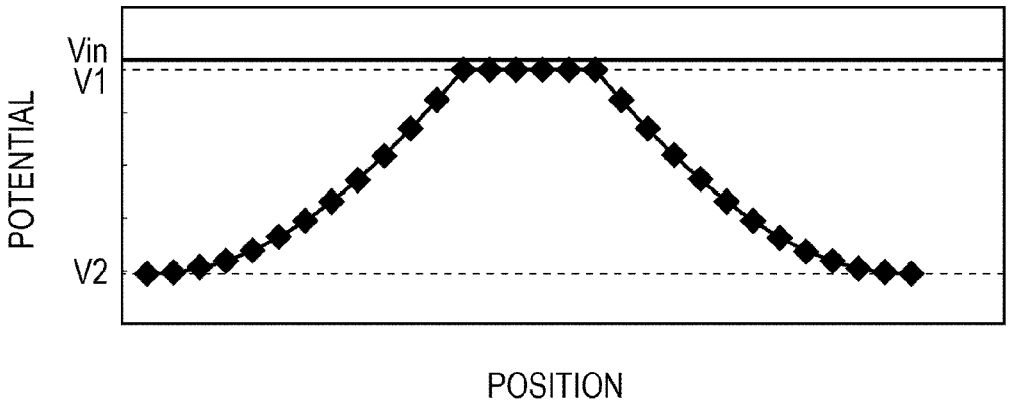
FIG. 10 is a diagram illustrating a potential distribution in a power supply area shown in FIG. 9.

For comparison, a simulation was also performed for a structure having no slit 7 shown in FIG. 9, and a result thereof in terms of the potential distribution along the edge AB is shown in FIG. 10. At the center of the edge AB of the power supply area 4, that is, on the center line M, a voltage drop of I occurs due to a current flowing straight from the power supply port 9. The potential at this point has a value V1 which is the highest along the edge AB. The potential decreases with the position from the center of the edge AB, and a lowest potential V2 is obtained at end points A and B that were the farthest from the center. The result of the simulation was as follows:

$$V1=V\text{in}-I$$

and $$V2=V\text{in}-79I.$$

Thus, the difference between the highest potential V1 and the lowest potential V2 was equal to 78I.

The potential difference in the present embodiment was smaller than that obtained in the comparative example.

Even in a case where the length a of the slit 7 is smaller than the connection width c of the terminal wiring conductor 5, if the slit 7 is formed such that the slit 7 extends across the shortest path, the slit 7 can cause the length of the shortest current path to be increased, and thus advantages according to aspects of the present invention can be achieved.

Figure 5:
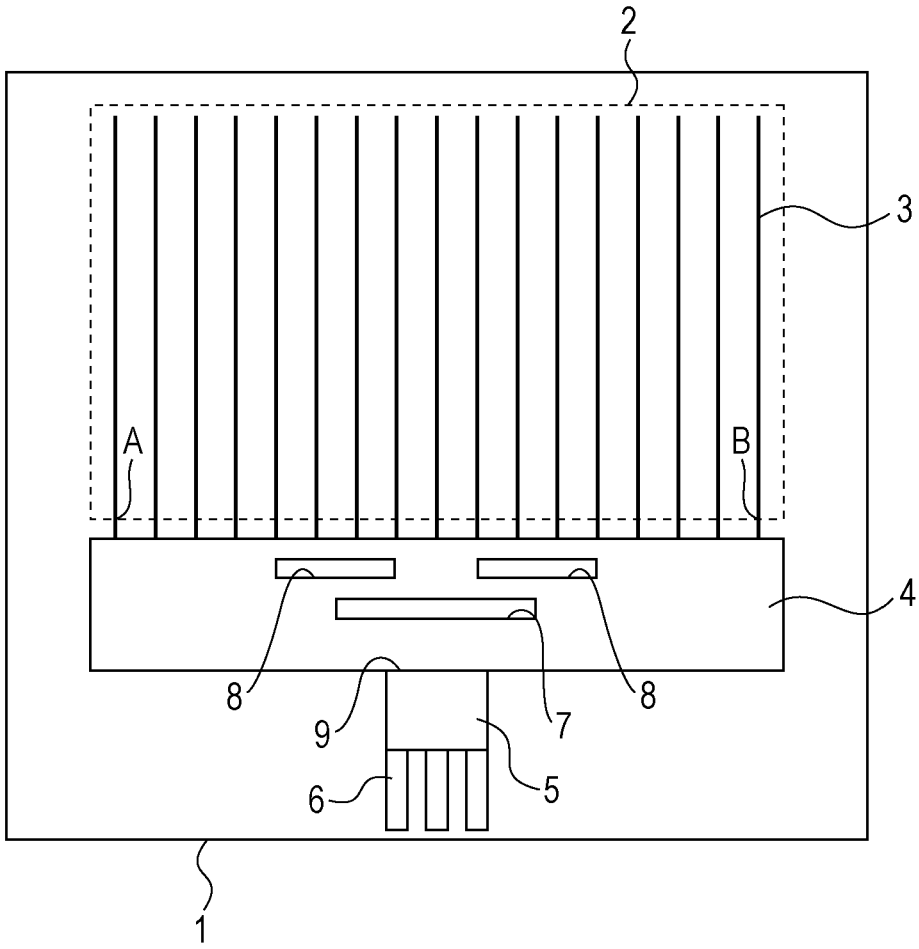
FIG. 5 is a diagram illustrating a layout of power supply paths in a display apparatus according to an embodiment of the present invention.
Figure 6:
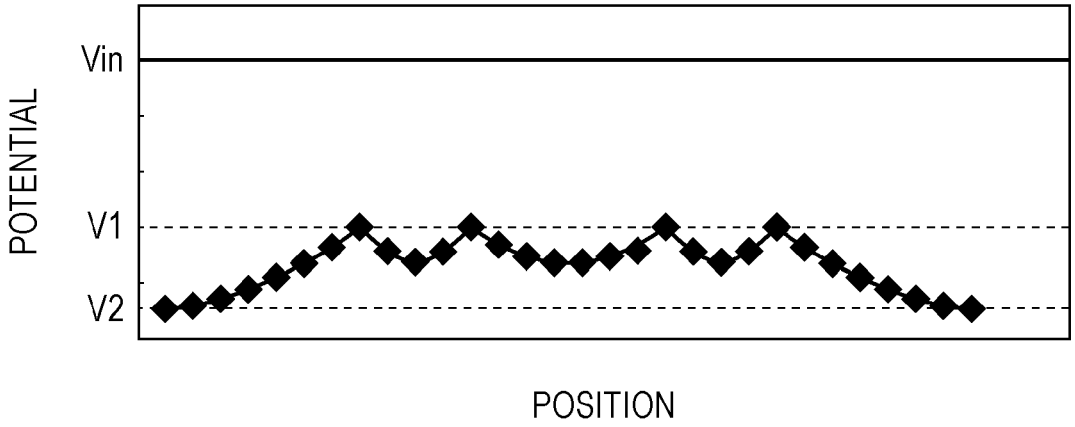
FIG. 6 a diagram illustrating a potential distribution in a power supply area shown in FIG. 5.

FIG. 5 illustrates a manner in which a power supply area is formed according to a second embodiment of the present invention. In FIG. 5, similar parts to those in FIG. 3 are denoted by similar reference numerals or symbols, and a further description thereof is omitted. FIG. 6 illustrates a potential distribution along the edge AB of the power supply area 4 on the side of the display area 2.

In the present embodiment, the power supply area 4 additionally includes second slits 8, and a slit (first slit) 7 is formed such that it has the same shape and is located at the same position as the slit 7 in the first embodiment. Each of the second slits 8 is formed on a shortest linear path from either end of the first slit 7 to the edge AB such that each of the second slits 8 extends across the corresponding shortest linear path. There is no connection between the two second slits 8 located at positions corresponding to respective ends of the first slit 7 such that the two second slits 8 form separate non-conductive areas. In this configuration, there are four paths that are equally shortest. These four paths pass by one of ends of the first slit 7 and further pass by one of ends of either one of the second slits 8 and finally reach the edge AB. Thus, in this configuration, as shown in FIG. 6, a highest potential occurs at four points corresponding to four ends of the two second slits 8. The line distance from the power supply port to either one of the points at which the highest potential occurs is greater than that in the first embodiment, and thus the highest potential V1 is lower than that in the first embodiment. Therefore, the difference between the highest potential V1 and the lowest potential V2 is smaller than that in the first embodiment, and thus a further improvement in uniformity of potentials is achieved.

The current fed in from the power supply port 9 is split into two streams by the first slit 7 and each stream is further split into two streams by one of the two second slits 8. After each two streams flow along detour paths around one of the second slits 8, the streams combine together at the back of the second slit 8, which results in a further improvement in uniformity of potential in the area at the back of the second slit 8.

Figure 7:
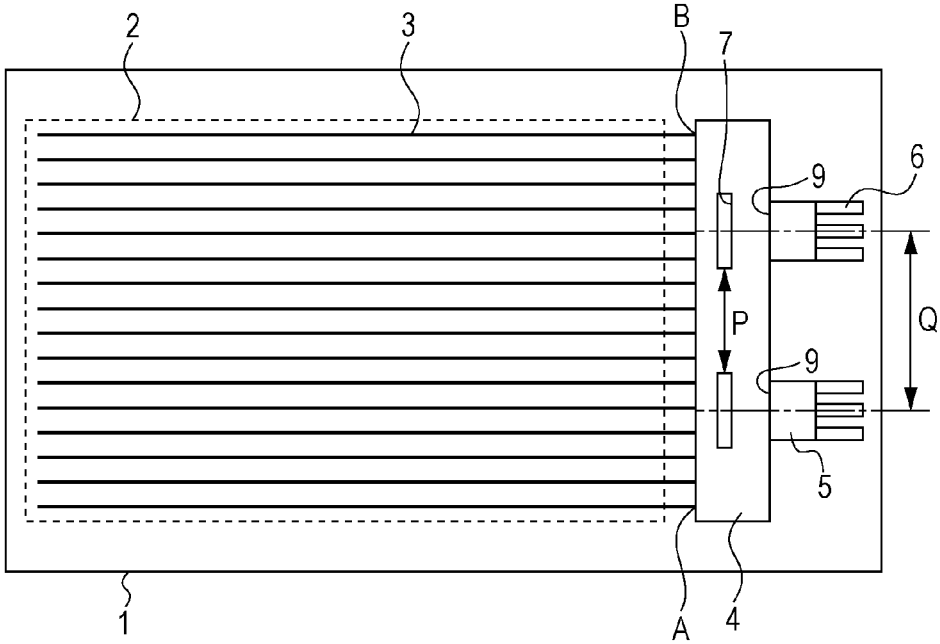
FIG. 7 is a diagram illustrating a layout of power supply paths in a display apparatus according to an embodiment of the present invention.
Figure 8:
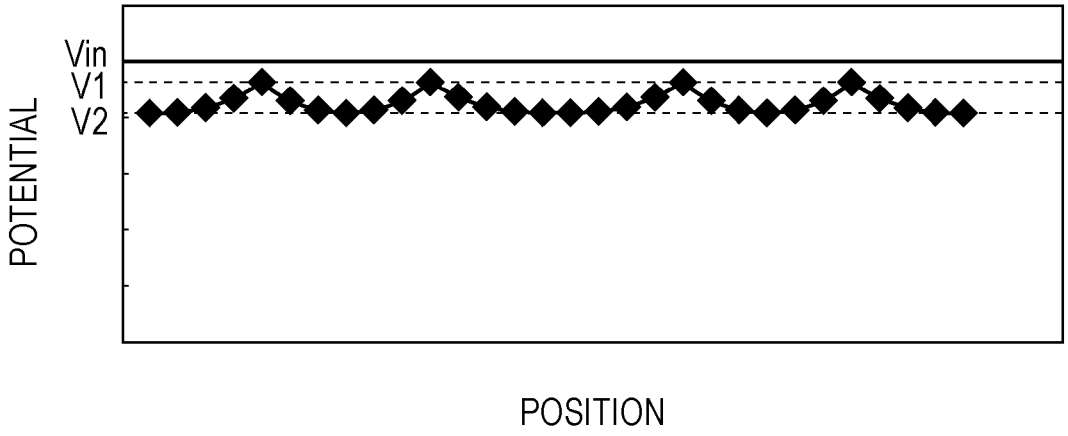
FIG. 8 is a diagram illustrating a potential distribution in a power supply area shown in FIG. 7.

FIG. 7 illustrates a manner in which a power supply area is formed according to a third embodiment of the present invention. In FIG. 7, similar parts to those in FIG. 3 are denoted by similar reference numerals or symbols, and a further description thereof is omitted. FIG. 8 illustrates a potential distribution along the edge AB of the power supply area 4 facing the display area 2.

In the present embodiment, connection terminals 6 are formed at two locations in a right-hand end area on a substrate 1. Terminal wiring conductors 5 extending from the connection terminals 6 are connected, at two locations, to the power supply area 4. As in the first embodiment, the power supply area 4 also has slits 7. However, in the present embodiment, two slits 7 are formed for respective terminal wiring conductors 5 such that each slit 7 is located in the middle of one of shortest paths from the power supply port 9 to the edge facing the display area 2. The two slits 7 have the same shape and are spaced by a distance P that is one-half the distance Q between center lines M1 and M2 of the respective two power supply ports 9.

Although in the example shown in FIG. 7, the power supply area 4 is located at a right side of the display area 2 and the pixel power supply lines 3 extend in a horizontal direction (along rows), the power supply area 4 may be located at a lower side of the display area 2 and the pixel power supply lines 3 may extend in a vertical direction as in the first or second embodiment.

In FIG. 8, the potential distribution along the edge AB, which faces the display area 2, of the power supply area 4 is plotted. The potential has a highest value V1 at four positions corresponding to ends of the two slits 7. Among many paths from the power supply port 9 to one of pixel power supply lines 3 including a detour around one of the slits 7, there are four shortest paths that pass by either one of ends of the slits 7 and reach at a right angle the edge AB of the power supply area. Thus, the potential distribution along the edge AB has four peaks corresponding to the four shortest paths. Furthermore, because the space between the slit 7 is set to be one-half the distance between the center lines of the tow power supply ports 9, the four peaks of potential occur at substantially equal intervals. In this configuration, a voltage drop in an area between the two slits 7 is nearly equal to a voltage drop in an area at the back the of slits 7, which results in a further improvement in uniformity of potential distribution.

Three or more power supply ports 9 may be provided at different locations. Also in this case, slits corresponding to the respective power supply ports 9 may be provided in a similar manner.

Figure 11:
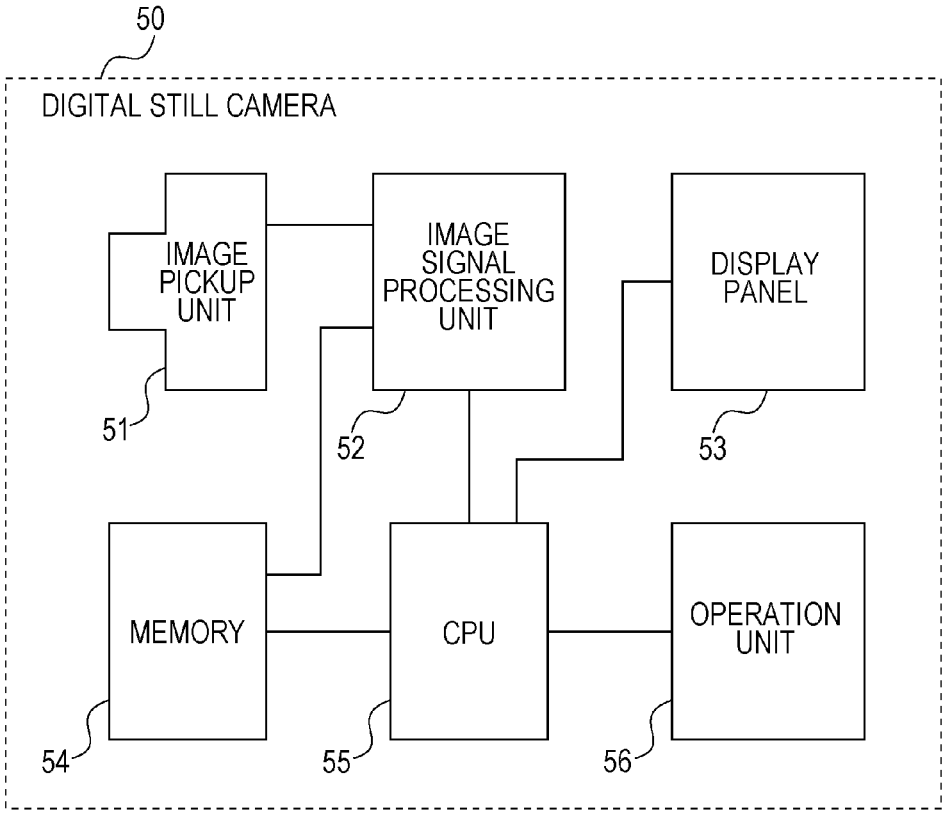
FIG. 11 is a block diagram illustrating a total configuration of a digital still camera system according to an embodiment of the present invention.

FIG. 11 is a block diagram illustrating a digital still camera system including a display apparatus according to an embodiment of the present invention. An image taken by an image pickup unit 51 or an image stored in a memory 54 is processed by an image signal processing circuit 52 and displayed on a display panel 53. A CPU 55 performs an operation of taking, storing, playing back, and/or displaying an image by controlling the image pickup unit 51, the memory 54, and the image signal processing circuit 52 according to a command or data input via an operation unit 56.

The light emitting apparatus according to the present embodiment of the invention may be applied not only to the digital camera but also to other display apparatuses such as a television set, a video camera, a portable telephone apparatus, etc. The light emitting apparatus according to the present embodiment of the invention may also be applied to other apparatuses such as a lighting apparatus, a line light emitting apparatus, etc. The line light emitting apparatus is a light emitting apparatus configured such that a plurality of separately controllable light emitting elements are arranged in one direction. The line light emitting apparatus may be combined with a photosensitive member and used in an image recording apparatus such as an optical printer, a copying machine, etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-071937 filed Mar. 26, 2010, which is hereby incorporated by reference herein in its entirety.

What is claimed is:

1. A light emitting apparatus including:

a plane-shape light emitting area;

a power supply area extending along the light emitting area, the power supply area supplying a current to the light emitting area across an edge of the power supply area facing the light emitting area; and a power supply voltage feeding part configured to feed a power supply voltage to the power supply area, the power supply voltage feeding part being connected to the power supply area at a power supply port provided on another edge of the power supply area opposite to the edge facing the light emitting area, wherein the power supply area includes a first non-conductive area surrounded by a conductive area located on a shortest path from a center of the power supply port to the edge of the power supply area facing the light emitting area, so that the difference between the length of the longest path and the length of the shortest path along the conductive area is reduced.

2. A light emitting apparatus according to claim 1, wherein the power supply area includes a second non-conductive area surrounded by the conductive area, the second non-conductive area being located on a shortest path from an end of the first non-conductive area to the edge of the power supply area facing the light emitting area.

3. A light emitting apparatus according to claim 1, wherein the center of the power supply port is located on a center line of the display area, and the first non-conductive area is symmetric in shape with respect to the center of the power supply port.

4. A light emitting apparatus according to claim 1, wherein the center of the power supply port is located off the center line of the display area, and the center of the first non-conductive area is located more off the center line of the display area than the center of the power supply port.

5. A light emitting apparatus according to claim 1, wherein the light emitting apparatus includes a plurality of power supply ports provided at locations on the edge of the power supply area facing the light emitting area, and one first non-conductive area is formed for each one of the power supply ports.

* * * * *